US007908821B2

(12) United States Patent
Prenn

(10) Patent No.: US 7,908,821 B2
(45) Date of Patent: Mar. 22, 2011

(54) POST WRAP DEVICE

(76) Inventor: Joseph Prenn, San Diego, CA (US)

( * ) Notice: Subject to any disclaimer, the term of this patent is extended or adjusted under 35 U.S.C. 154(b) by 468 days.

(21) Appl. No.: 11/339,986

(22) Filed: Jan. 25, 2006

(65) Prior Publication Data

US 2007/0193203 A1 Aug. 23, 2007

(51) Int. Cl.
*E04C 3/00* (2006.01)

(52) U.S. Cl. ..... 52/835; 52/844; 52/836; 52/288.1; 52/169.13; 52/745.06

(58) Field of Classification Search ..... 52/844, 52/843, 834, 835, 836, 170, 736.4, 426, 562, 52/383, 565, 40, 169.13, 218, 288.1, 290, 52/219, 287.1, 591.1, 212, 36.3, 741.3, 745.06, 52/745.15

See application file for complete search history.

(56) References Cited

U.S. PATENT DOCUMENTS 1,250,594 A * 12/1917 Knapp ..... 52/288.1
1,756,023 A * 4/1930 Felsenthal ..... 138/156
1,842,308 A * 1/1932 Bohnsack ..... 52/844
1,883,214 A * 10/1932 Wilson et al. ..... 428/33
1,917,365 A * 7/1933 Goertz et al. ..... 52/282.3
3,199,258 A * 8/1965 Jentoft et al. ..... 52/222
3,355,852 A * 12/1967 Lally ..... 52/834
3,707,061 A * 12/1972 Collette et al. ..... 52/288.1
4,034,535 A * 7/1977 Dustmann ..... 52/834
4,084,360 A * 4/1978 Reckson ..... 52/63
4,150,517 A * 4/1979 Warner, Sr. ..... 52/288.1
4,467,584 A * 8/1984 Crites et al. ..... 52/834
4,484,427 A * 11/1984 Crites et al. ..... 52/834
4,621,471 A * 11/1986 Kuhr et al. ..... 52/288.1
4,843,783 A * 7/1989 Taravella ..... 52/98
4,918,765 A * 4/1990 Harding ..... 4/460
4,934,114 A * 6/1990 Lindsey ..... 52/40
5,335,471 A * 8/1994 Kupiec ..... 52/834
5,622,356 A * 4/1997 Duggan ..... 256/1
5,832,675 A * 11/1998 Zuares ..... 52/60
5,901,525 A * 5/1999 Doeringer et al. ..... 52/835
5,921,056 A * 7/1999 Weiss et al. ..... 52/745.16
5,924,259 A * 7/1999 Marousek ..... 52/656.1
5,956,920 A * 9/1999 Davis ..... 52/844
5,974,744 A * 11/1999 Guilbeault ..... 52/170
6,009,683 A * 1/2000 Grewe et al. ..... 52/834
6,148,566 A * 11/2000 Giszpenc et al. ..... 52/27
6,295,783 B1 * 10/2001 Davis ..... 52/834
6,412,250 B2 * 7/2002 Davis ..... 52/834
6,519,906 B2 * 2/2003 Yost et al. ..... 52/426

(Continued)

OTHER PUBLICATIONS

Office Action issued by the U.S. Patent and Trademark Office in corresponding U.S. Appl. No. 12/179,401 dated Sep. 16, 2009.

*Primary Examiner* — Robert J Canfield
*Assistant Examiner* — Babajide Demuren
(74) *Attorney, Agent, or Firm* — Knobbe Martens Olson & Bear LLP

(57) ABSTRACT

Embodiments are described of devices for concealing and/or protecting a portion of a member, such as the base of a post, which devices can be easily applied to the member at any time. These embodiments include a plurality of components adjustably connected to one another so as to provide a snug fit of the device against the member to be protected, regardless of initial variations from the expected dimensions of the member. Further device embodiments are self-adjusting to provide a snug fit regardless of subsequent changes in the dimension of the member over time.

13 Claims, 12 Drawing Sheets

U.S. PATENT DOCUMENTS

| | | | | |
|---|---|---|---|---|
| 6,712,546 | B1 * | 3/2004 | Radu et al. | 404/8 |
| 6,795,986 | B2 * | 9/2004 | Marbach et al. | 4/506 |
| 6,826,880 | B2 * | 12/2004 | Yost et al. | 52/309.11 |
| D521,656 | S * | 5/2006 | Terrels | D25/122 |
| 7,104,525 | B2 * | 9/2006 | Ricci | 256/65.14 |
| 7,146,774 | B2 * | 12/2006 | Fredette | 52/656.6 |
| 7,210,272 | B2 * | 5/2007 | Friday | 52/288.1 |
| 7,243,473 | B2 * | 7/2007 | Terrels | 52/843 |
| 7,278,240 | B2 * | 10/2007 | Burkart et al. | 52/155 |
| 2002/0017072 | A1 * | 2/2002 | Davis | 52/736.3 |
| 2003/0051416 | A1 * | 3/2003 | Inzeo | 52/40 |
| 2004/0206028 | A1 * | 10/2004 | Terrels et al. | 52/287.1 |
| 2004/0221541 | A1 * | 11/2004 | Fredette | 52/716.1 |
| 2005/0160697 | A1 * | 7/2005 | Oliphant et al. | 52/731.4 |
| 2005/0229531 | A1 * | 10/2005 | Green et al. | 52/736.1 |
| 2006/0010824 | A1 * | 1/2006 | Waters et al. | 52/738.1 |
| 2006/0117704 | A1 * | 6/2006 | Yoon et al. | 52/737.4 |
| 2006/0185270 | A1 * | 8/2006 | Handley et al. | 52/169.14 |
| 2007/0119107 | A1 * | 5/2007 | Shaw et al. | 52/287.1 |
| 2007/0163187 | A1 * | 7/2007 | Price | 52/169.12 |
| 2008/0155925 | A1 * | 7/2008 | Pfeiffer | 52/426 |

* cited by examiner

POST WRAP DEVICE

FIELD OF THE INVENTION

This invention is directed to an apparatus for concealing and/or protecting a portion of a support member, such as the base of a post.

DESCRIPTION OF THE RELATED ART

Various types of devices have been developed in attempts to conceal and/or protect the bases of posts. Many of these devices comprise a monolithic sleeve which can be slid over the top of a post and brought down to cover the base of the post. Other devices comprise two portions which can be brought in contact with one another to surround the portion of the post to be concealed.

In many applications, particularly in the construction industry, it is desirable to provide an apparatus which is capable of covering the base of a post. In certain embodiments, such coverage is primarily an aesthetic feature, but in other embodiments, such coverage may provide protection to the base of the post and any associated components, as well as protection to persons who otherwise may be injured by contact with the covered elements, such as bolts and brackets. A post such as one used, for example, in the construction of a deck, is often secured to a slab or footing through the use of a large post bracket. An exposed post bracket may be both a safety hazard, as well as aesthetically unappealing, particularly when other protective materials, such as sealants, have been applied at the base of the post. In order to conceal such post brackets and other fixtures, a structure may be provided which covers the base of the post, enclosing the post bracket or other components of the post. In addition to the safety and aesthetic benefits of such a structure, these devices can also be used to protect the base of the post, such as by preventing water from pooling at the base of the post.

As discussed above, in certain existing art devices, the protective structure takes the form of a sleeve, which is slid over the top of the post once the base of the post has been fixed in place, but must be applied prior to securing anything to the top of the post, such as components of a deck to be supported. The timing of such application may be inconvenient, however, as the use of such a device requires the protective device to be applied essentially prior to the use of the post as a support. In addition, if such a device is damaged, or if one desires to remove or replace the device for any other reason, such removal would be extremely inconvenient, and replacement may not be possible.

Other existing devices are formed from two separate components, which can be brought together to form a protective structure. While these devices can be applied at any point in the construction process, and thus address one of the problems with the monolithic sleeve devices, they share other drawbacks with those devices. Of particular concern is their lack of adjustability to variances in post dimensions. Previously available devices have been sized to fit a particular post dimension. However, posts utilized in the construction industry, particularly timber posts, have a substantial amount of variance in their actual dimensions.

In addition to variance which exists at the time of cutting the wood post, the dimensions of the post may vary throughout the life of the post in response to absorbtion or evaporation of moisture. Such two-part devices cannot easily take into account such variances in post dimension, and the resulting structure is likely to either be too small for the post, resulting in stress and potential damage to the device upon device installation, or too large for the post, resulting in an undesirably large gap between the post and the edges of the protective device. These variations in size can hinder the usefulness of the structure as a protective device, in addition to being aesthetically unappealing.

To some extent, these issues can be addressed if protective structures are constructed on-site for each post base, taking into account the current dimensions of the post. However, production of such custom protective structures requires a considerable amount of work and expense on the part of the tradesmen working on-site, and do not fully address the potential variance in the dimensions of the post over the lifetime of the device.

SUMMARY OF THE INVENTION

In one embodiment, an apparatus is provided for enclosing a portion of a member, including a plurality of corner components, each of the plurality of corner components configured to contact a different portion of the member, and each of the plurality of corner components configured to adjustably and mechanically be connected to another of the corner components such that the corner components are adjustable with respect to one another so as to be secured against the member.

In another embodiment, an apparatus is provided for enclosing a portion of a member, the apparatus including a plurality of components, and the components cooperating to define a perimeter, wherein the components are configured to mechanically be connected to one another and are adjustable to vary the size of the perimeter to enclose a portion of the member.

In another embodiment, a method for enclosing a portion of a member is provided, the method including adjustably connecting a plurality of components to one another about the surface of a member so as to define a perimeter, said perimeter coinciding with the dimensions of the member.

In yet another embodiment, an apparatus for enclosing a portion of a member is provided, the apparatus comprising means for enclosing a portion of a member, means for retaining the enclosing means against the surface of the member, and means for adjustably connecting said enclosing means.

DETAILED DESCRIPTION OF THE PREFERRED EMBODIMENT

In contrast to existing devices, embodiments of the present invention provide a multi-component protective post wrap apparatus which can be applied at any time during in the construction process and which can readily adjust to variances in both the initial dimensions of a post and any variance which may result over time. In addition, due to the adjustability of these devices, the necessary components may be manufactured in large quantities, reducing the cost of the apparatus. The post wrap apparatus may alternately be referred to as a skirt, an apron, or a shroud. Generally, embodiments of the post wrap apparatus described herein serve to circumscribe the extremity of a member, and may serve to protect, embellish or conceal the termination and/or connection of interconnecting frame components or members.

For convenience, the terms post and base are used throughout this application, but it will be understood that embodiments of the present invention may be applied at any point where a member meets another surface, in order to cover the portion of the member proximate the surface. For instance, if desired, the protective structures described herein may be applied at the end of a beam which intersects a wall, or at a point in a frame where one member intersects another member.

In a first embodiment, a post wrap apparatus includes a plurality of corner components and an equal number of intermediate components. The number of corner and intermediate components is dependent upon the cross-sectional shape of the post to be covered. In a typical embodiment, the post will be rectangular in cross-section, and the post wrap apparatus will include four corner components and four intermediate components. An example of such an embodiment is depicted in FIG. 1.

Figure 1:
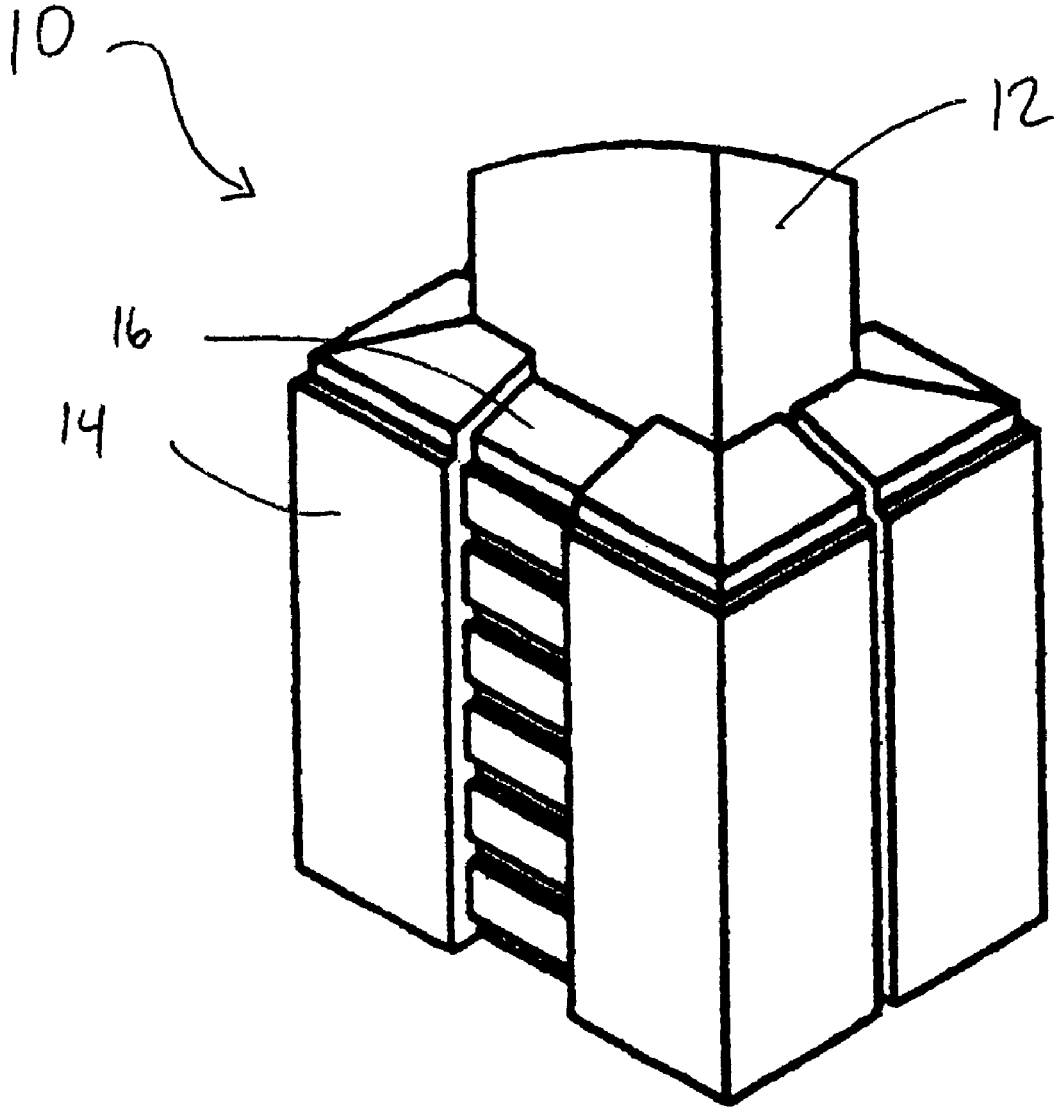
FIG. 1 is a perspective view of one embodiment of an assembled post wrap device in place around a post.

FIG. 1 is a perspective view of an assembled post wrap apparatus 10, which has been applied around a rectangular post 12. The post wrap apparatus 10 comprises four corner components 14, each of which is configured to slidably interact with an intermediate component 16, one on each of the two sides of the corner component 14. In this way, it can be seen that such a post wrap apparatus 10 can be assembled around a post after the post is fixed into place, without the need to slide the assembled apparatus down over the top of the post. Thus, the post wrap apparatus 10 can be readily placed around the post base at any time during or after construction of the structure supported by the post 12, and may also be removed or adjusted at any time.

Figure 2A:
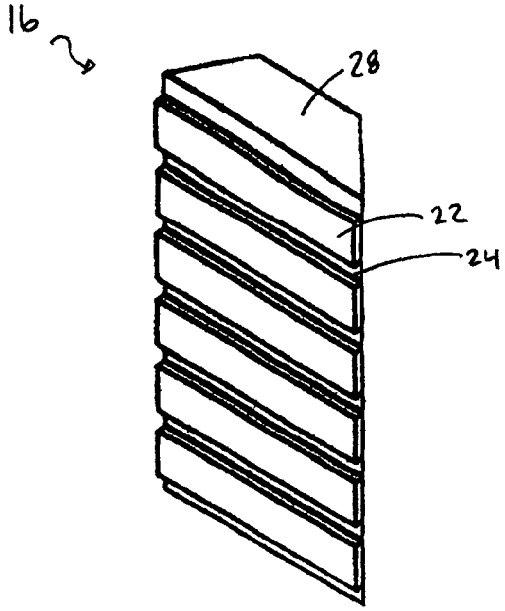
FIG. 2A is a perspective view of an intermediate component of the post wrap device of FIG. 1.

With respect to FIG. 2A, it can be seen that, in the illustrated embodiment, the intermediate component 16 comprises an exterior face 20 having positive rail features 22 extending horizontally along the exterior face 20. These rail features 22 serve to define negative groove features 24 which are configured to receive corresponding glides, or rail features, located on the corner components to be describe hereinafter with reference to FIG. 3A. The mating relationship of the grooves 24 and the glides facilitates the slidable and adjustable interconnection of the two components. In the illustrated embodiment, several such rail and groove features are provided on the intermediate component, in order to provide a secure connection, as well as an aesthetically pleasing appearance. However, it will be understood that in other embodiments, fewer or greater numbers of rail and groove features may be provided on the intermediate components. In addition, it will be understood that other shapes may be utilized to permit the desired slidable interconnection.

Figure 2B:
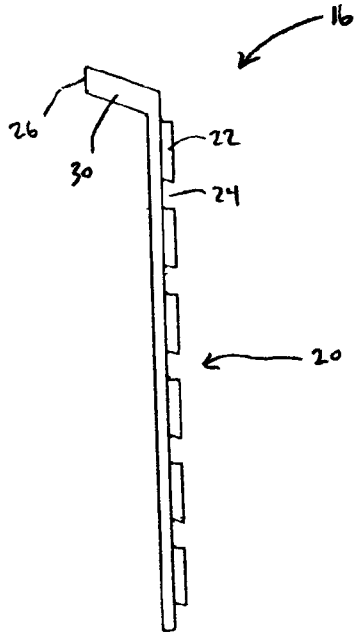
FIG. 2B is a side view of the intermediate component of FIG. 2A.
Figure 2C:
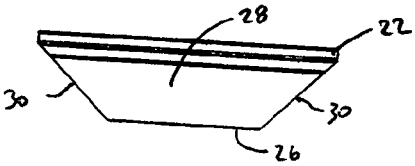
FIG. 2C is a top view of the intermediate component of FIG. 2A.
Figure 2D:
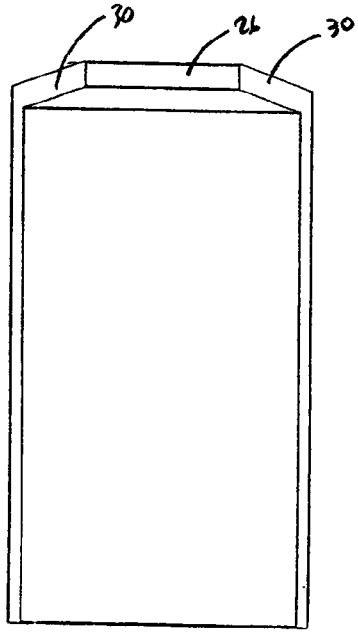
FIG. 2D is another side view of the intermediate component of FIG. 2A.
Figure 3A:
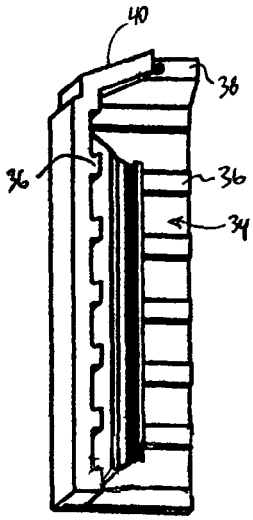
FIG. 3A is a perspective view of a corner component of the post wrap device of FIG. 1.

As can be best seen in FIG. 2B, in a preferred embodiment, the underside of the rail features 22 is undercut slightly, and the corresponding rail features on the corner component will have a complimentary profile (See, e.g., FIG. 3A). This undercut constrains movement of a corner component relative to an interlocked intermediate component to a direction parallel to the axes of the groove features, preventing the corner component from moving away from a surface of the post without the intermediate component moving, as well.

The intermediate component 16 also comprises an interior vertical face 26, which is configured to be positioned flush against a face of the post when the post wrap apparatus 10 is in an assembled state. The component 16 also comprises an upper surface 28, which in preferred embodiments slopes downwards away from the interior face 26, so that water runs off the surface 28, away from the post. Intermediate component 16 also comprises two angled side faces 30, one on each side of the intermediate component. In a preferred embodiment, the angled side faces 30 are arranged at a 45 degree angle to the front face 20 and interior face 26, such that if necessary, one intermediate component 16 can be brought into contact with another intermediate component 16, in order to adjust the size of the perimeter defined by the upper portions of the post wrap device in order to snugly fit against a post having a small dimension.

It can be seen by reference to FIG. 3A that the corner component 16 comprises two vertical interior faces 34 oriented orthogonally to one another. Glides 36, which are elongated members having a constant cross-sectional shape, are located on each of these interior faces 34, and configured to slidably interconnect with the grooves 24 on the exterior face 20 of the intermediate components 16. These glides 36 extend horizontally, in the illustrated embodiment, from one edge of the interior face to the other. In preferred embodiments, the glides 36 have an undercut on their upper surface, so that matching edge on the rail 22 on the intermediate component 16 covers the glides, and prevents water retention on the interior of the post wrap apparatus.

Referring again to FIG. 3A, corner component 14 also includes upper interior faces 38, which like the interior face 26 of intermediate component 16, are configured to be positioned flush against the sides of the post 12 when the post wrap apparatus is assembled. The corner component 14 further includes upper portions 40, which are preferably sloped at the same angle as the upper surface 28 of the intermediate component, such that the intermediate component can slide underneath the upper portions 40. In further embodiments (not shown), the corner component may comprise a spacer member located near the bottom of the corner component, which extends outward from the vertical interior faces 34 and is configured to contact the surfaces of the post, preventing the lower portion of the corner component from being pulled too far towards the post.

Figure 3B:
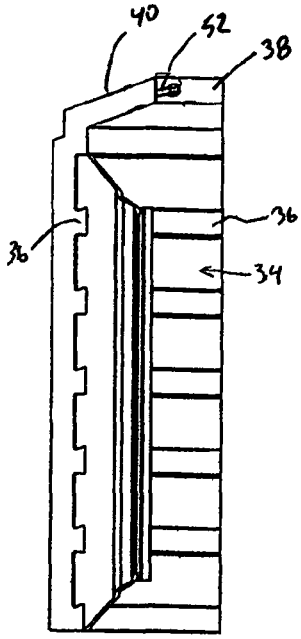
FIG. 3B is a side view of the corner component of FIG. 3A.
Figure 3C:
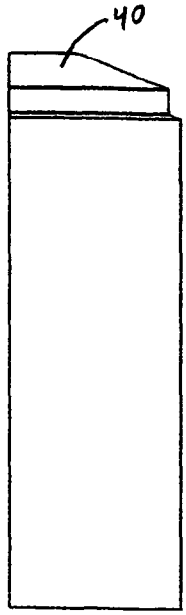
FIG. 3C is another side view of the corner component of FIG. 3A.
Figure 3D:
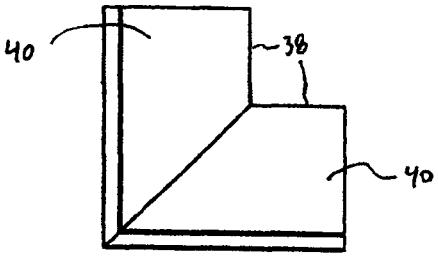
FIG. 3D is a top view of the corner component of FIG. 3A.
Figure 3E:
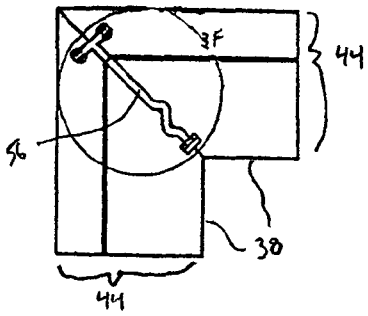
FIG. 3E is a view from underneath the corner component of FIG. 3A.

In the illustrated embodiment, as best seen in the bottom plan view of FIG. 3E, the corner component may be formed from two separate pieces 44 which are then joined together to form the corner component. Such a process advantageously simplifies the fabrication of the post wrap apparatus components, permitting the use of, for example, an extrusion process to fabricate the components in an inexpensive manner. In the illustrated embodiment, it can be further seen that the two pieces 44 are joined together through the use of a spline 46 within a cavity 48, also referred to as a kerf, which extends into each of the two pieces 44 and runs vertically through the corner of the corner component 14. The pieces 44 can then be joined together through, for example, filling the remainder of the cavity 48 with a curing sealant. The spline 46 can preferably have a contoured surface, as shown, in order to enhance the retention of the sealant, preventing the spline from being pulled away from the surrounding sealant. As can be seen in FIG. 3B, a chamfered spine 52 can be used in a similar fashion to join the upper portions 40 to one another.

Figure 3F:
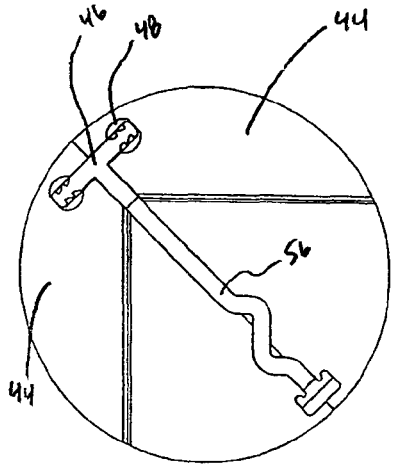
FIG. 3F is a detailed view of section 3F of FIG. 3E.

As can also be seen in FIG. 3E, in the illustrated embodiment the spline 46 forms a portion of a spring member 56, which extends inward from the interior of the corner component 14 towards the post. This can be seen in greater detail in FIG. 3F, which is a detailed view of a portion of FIG. 3E. As will be discussed in greater detail below, the spring member 56 extends from the corner component 14 to a location where it is fixed to the post, and the restoring force of the spring serves to hold the corner component, and particularly the interior faces 28 of the corner component, secure against the surfaces of the post 12.

Figure 4B:
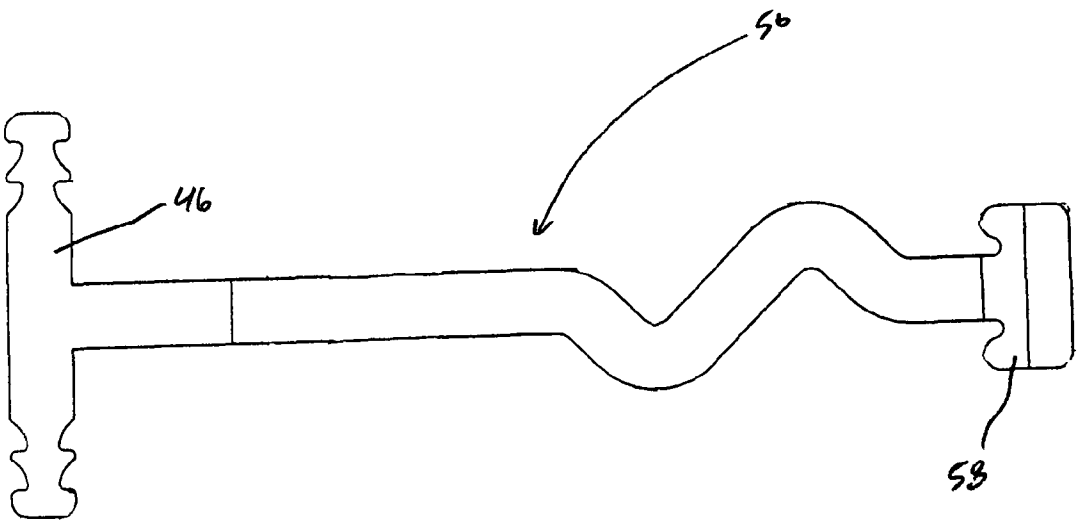
FIG. 4B is a cross-section of the spring member of FIG. 4A.
Figure 4A:
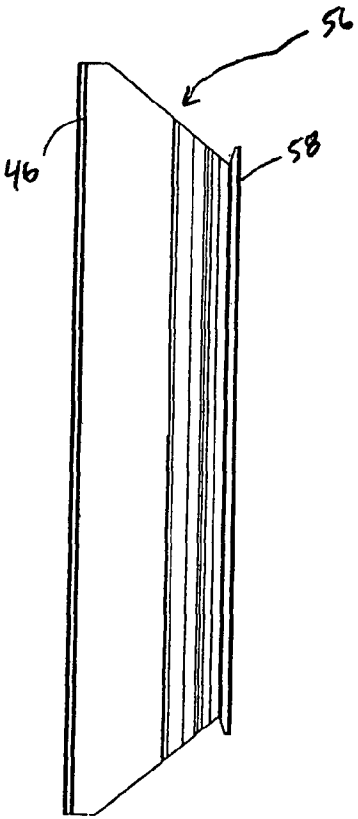
FIG. 4A is a side view of a spring member which may be utilized in conjunction with the corner component of FIG. 3A.

FIG. 4A depicts a side view of the spring member 56, which in the illustrated embodiment comprises a single elongated piece. In one embodiment, the spring member 56 is a polymeric spring member. In some embodiments, the spring member 56 may be fabricated by an extrusion process, and may comprise a polymeric material such as acetal or noryl. As can be seen in FIG. 4B, a cross-sectional view of the spring member 56, the spring member comprises a glide 58 on the end of the spring member opposite the spline 46. In alternate embodiments, the spring member 56 may be a component distinct from the spline 46, particularly in embodiments in which a spline is not used to join the corner component 14 together. The spring member may also be shaped differently. For instance, the spring member may not comprise an elongated portion extending along most of the length of the corner component, or more than one spring member may be included per corner component.

Figure 5A:
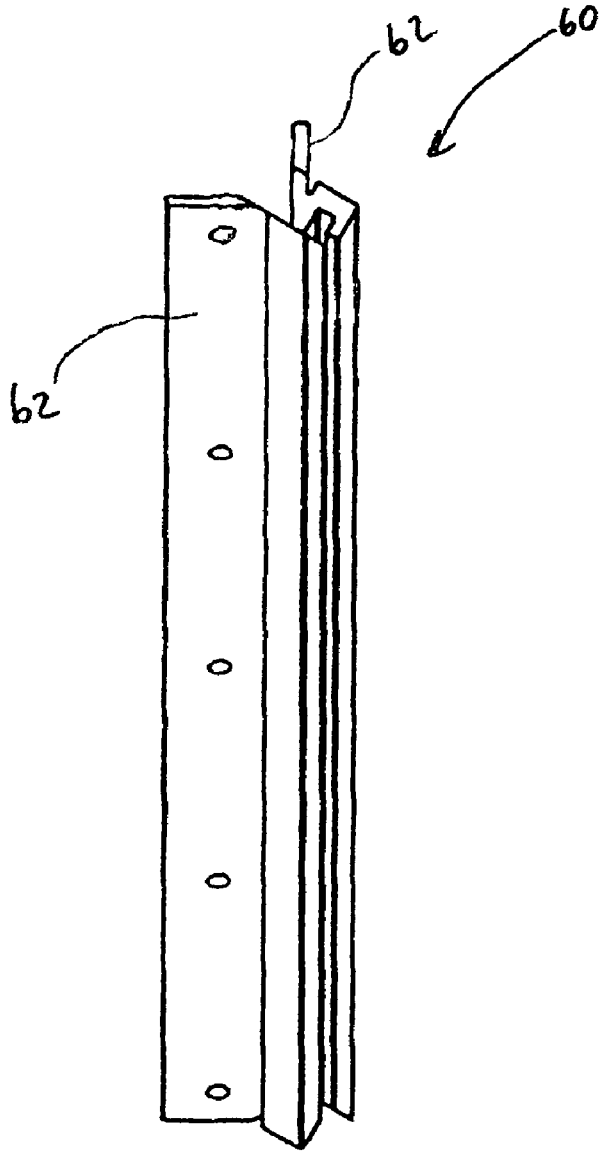
FIG. 5A is a perspective view of a bracket which may be utilized in conjunction with the corner component of FIG. 3A.
Figure 5B:
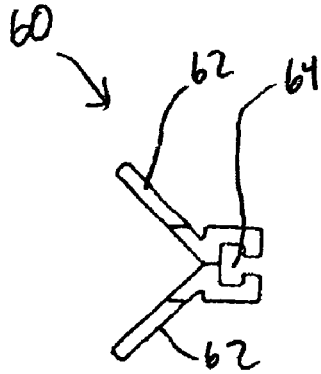
FIG. 5B is a cross-section of the bracket of FIG. 5A.

FIGS. 5A and 5B depict a bracket 60, also referred to as a post slide or a sliding latch, which may be secured to a corner of the post prior to the securing of the post wrap apparatus around the post. FIG. 5A is a perspective view of the bracket 60 and FIG. 5B is a cross-section of the bracket. The bracket 60 comprises wings 62 which can be used to secure the bracket to the post, as well as a channel 64 running the length of the bracket, configured to receive the slide 58 of the spring member 56. As can be seen in the perspective view of FIG. 5A, the upper portion of the bracket may be notched to facilitate reception of the slide 58.

Figure 6A:
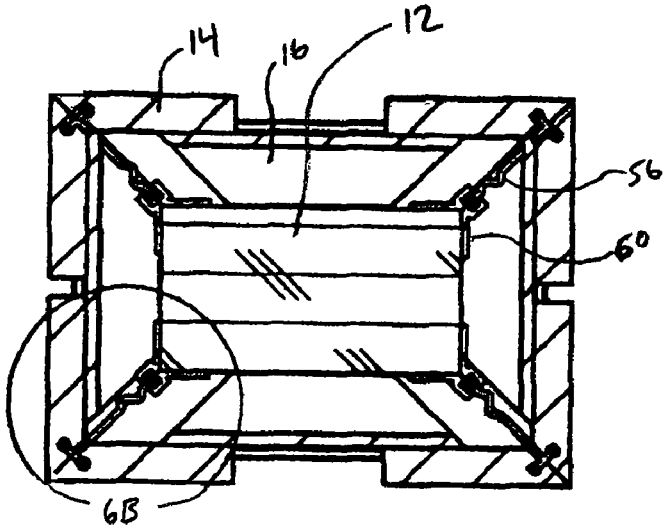
FIG. 6A is view from underneath the assembled post wrap device of FIG. 1.
Figure 6B:
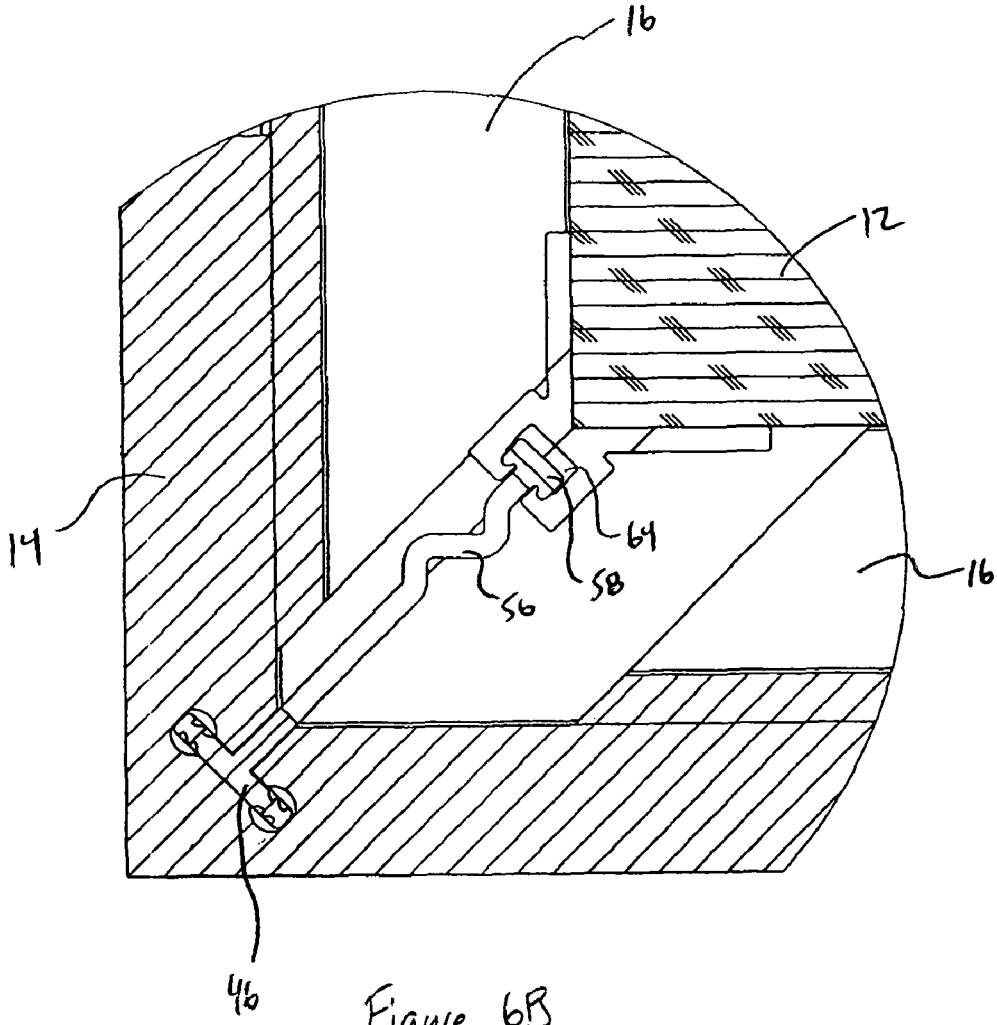
FIG. 6B is a detailed view of section 6B of FIG. 6A.

FIG. 6A depicts a cross-section of the assembled and secured post wrap apparatus, and FIG. 6B is a detailed cross-section of one corner of the post wrap apparatus. As can be seen, the bracket 60 has been secured to the post 12. The glide 58 of the spring member 56 has then been received by the channel 64 of the bracket 60. The restoring force of the spring member secures the corner component 14 flush against the corner of the post 12, and the corner components 14, in turn, pull the intermediate components 16 against the surfaces of the post 12. Advantageously, because the components are held in place by the restoring force of the spring members, and are not fixed relative to one another, the post wrap apparatus will be self-adjusting if there is any change in the cross-sectional dimensions of the post over time.

In one embodiment, a process for applying such a post wrap apparatus to the base of a post includes first securing the brackets 60 to the post 12. The corner components 14 and the intermediate components 16 may then be fixed to one another around a location on the post 12 located away from the brackets 60, defining a perimeter around the post. Typically, the components 14 and 16 will be assembled at a location on the post which is farther from the base of the post than the brackets are from the base of the post. The corner components 14 and the intermediate components 16 are then brought towards the brackets 60 so that the glides 58 of the spring members 56 enter and are retained by the channels 64 of the brackets 60.

Figure 7A:
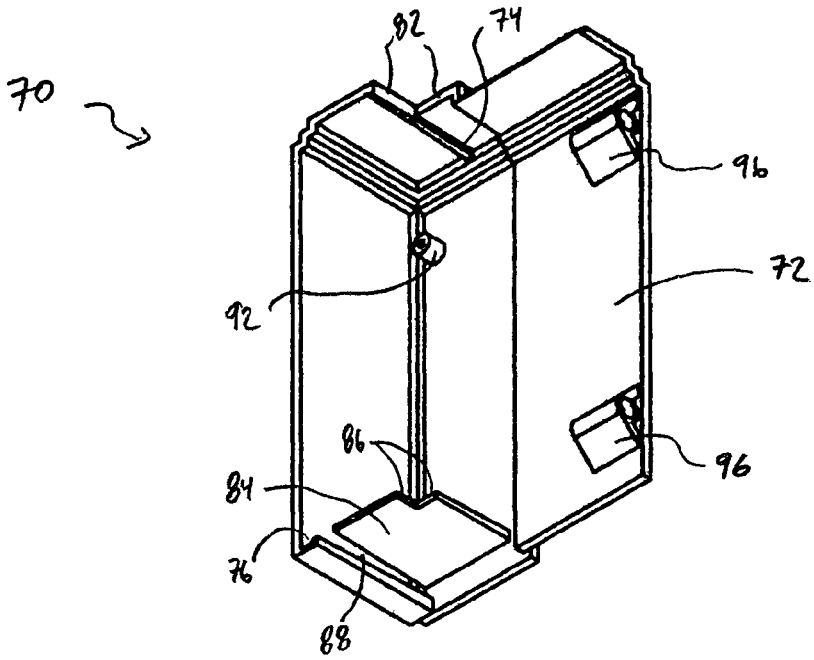
FIG. 7A is a perspective view of a corner component which forms a part of an alternate embodiment of a post wrap device.
Figure 7B:
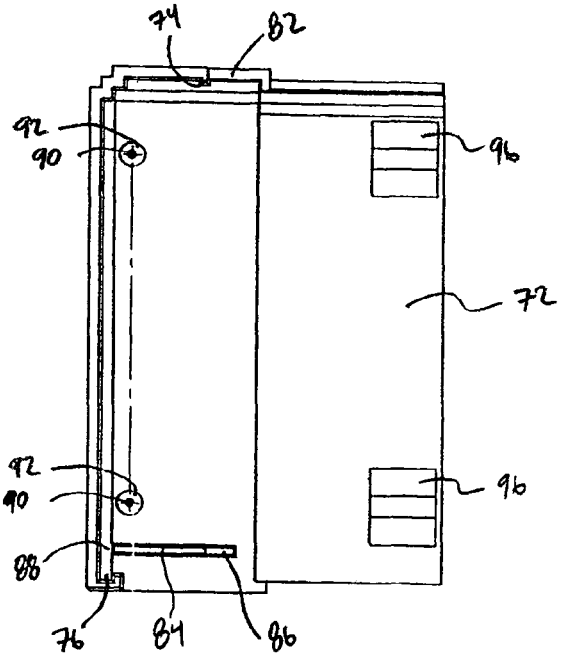
FIG. 7B is a side view of the corner component of FIG. 7A.
Figure 7C:
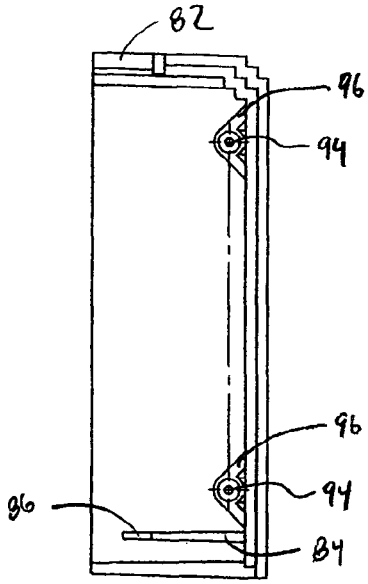
FIG. 7C is another side view of the corner component of FIG. 7A.

In a second embodiment a post wrap apparatus 70 comprises a plurality of corner components as depicted in FIGS. 7A-7C. In this embodiment, no intermediate components are utilized. Rather, each corner component 70 comprises a wing portion 72 extending from one side of the corner component, and configured to slidably interconnect with an open side 73 another corner component 70.

Referring now to FIG. 7A, the open side 73 of the corner component 70, configured to receive and retain the wing portion 72 of the adjacent corner component, comprises features designed to constrain movement of the wing portion in undesirable directions. In this embodiment, the corner component 70 comprises a protrusion 74 extending from the upper interior surface of the corner component. This protrusion 74 is configured to restrain the upper portion of the wing portion 72, which in this embodiment is a raised member extending the length of the upper interior surface of the corner component in a direction parallel to the wall of the open side 73. The corner component 70 also comprises a groove 76 configured to receive and retain the lower portion of the wing portion 72, and defined by a lipped member located near the base of the corner component extending horizontally along the open side 73 of the corner component 70.

As with the corner component 14 discussed above, the corner component 70 comprises two upper interior faces 82 orthogonal to one another, and configured to contact the surfaces of the post. The corner component 70 also comprises a spacer member 84, which in the illustrated embodiment is a substantially horizontal planar member extending from the interior walls of the corner component and located near the base of the corner component. The spacer member 84 has a notched corner which defines two interior faces 86 configured to contact the surfaces of the post and prevent the lower portion of the corner component from sliding inwards toward the post. A gap 88 is provided between the spacer member 84 and the wall of the corner component 70 in order to accept a wing portion 72 of another corner component.

As can be seen in FIG. 7A, the corner components 70 in the illustrated embodiment comprise two apertures 90 which extend through a wall of the corner component and through two bosses 92 located on the interior of the corner components. It can be seen, in the illustrated embodiment, that the apertures are located the same distance from the corner of the corner component, with one of the apertures located near the upper surface of the corner component and the other located near the base of the corner component. The wing portions 72 also comprise a pair of bosses 94 having apertures 96 extending through them. The respective bosses 96 are at the same heights as the respective bosses 92, and the apertures 90 of bosses 92 are aligned with the apertures 94 extending through bosses 96, such that a fastener can be inserted through the upper boss 92 of a first corner component and extend through the upper boss 96 of a second corner component.

Figure 8A:
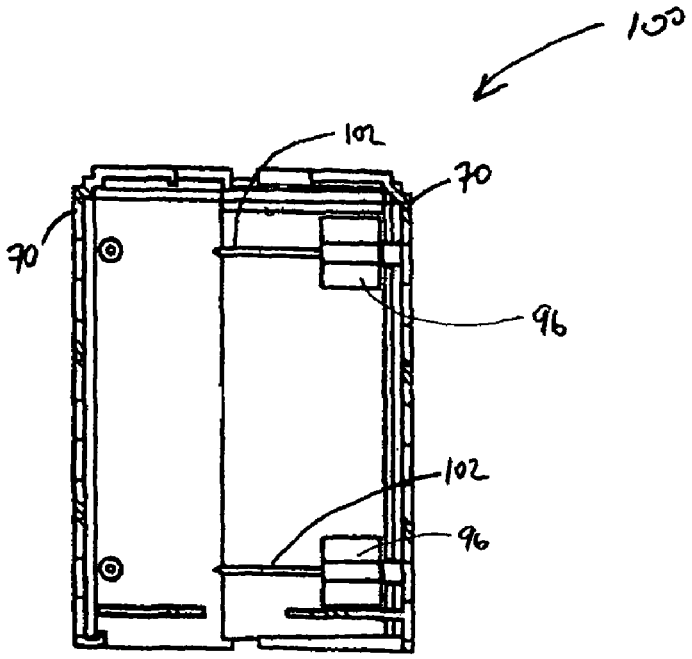
FIG. 8A is a cross-section of an assembled post wrap device utilizing the corner components of FIG. 7A.
Figure 8B:
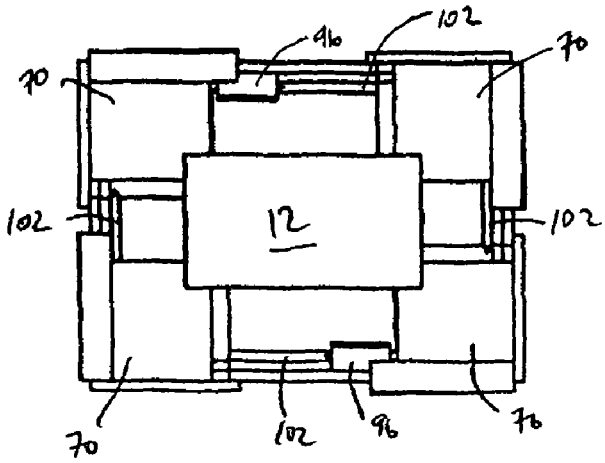
FIG. 8B is a view from underneath the assembled post wrap device of FIG. 8A.

FIG. 8A depicts a side view of the assembled post wrap apparatus 100, and FIG. 8B depicts a view of the assembled post wrap apparatus from underneath. It can be seen in FIGS. 8A and 8B that the corner components 70 have been slidably interconnected with one another. Subsequently, fasteners 102 have been inserted through the apertures 90 of bosses 92 of one corner component 70, and into the apertures 94 of bosses 96 located on the wing section 72 of another corner component, securing the corner components to one another. In one embodiment, the bosses 96 comprise a threaded insert, and the fastener 102 comprises a threaded screw, such as a machine screw. In another embodiment, the fastener 102 comprises a self-tapping screw.

It will be understood that the post wrap apparatus is thus adjustable to allow coverage of posts having a wide variety of dimensions, as the distance which the wing portion of one corner component is inserted into the adjacent corner component can be varied. While this post wrap apparatus 100 is not self-adjusting to subsequent variations in post size, the post wrap apparatus retains the advantages of being installable at any point in the construction process and adjustable to fit a wide variety of post dimensions. Further, the post wrap apparatus can be easily adjusted manually to accommodate subsequent changes in post dimensions.

Figure 9A:
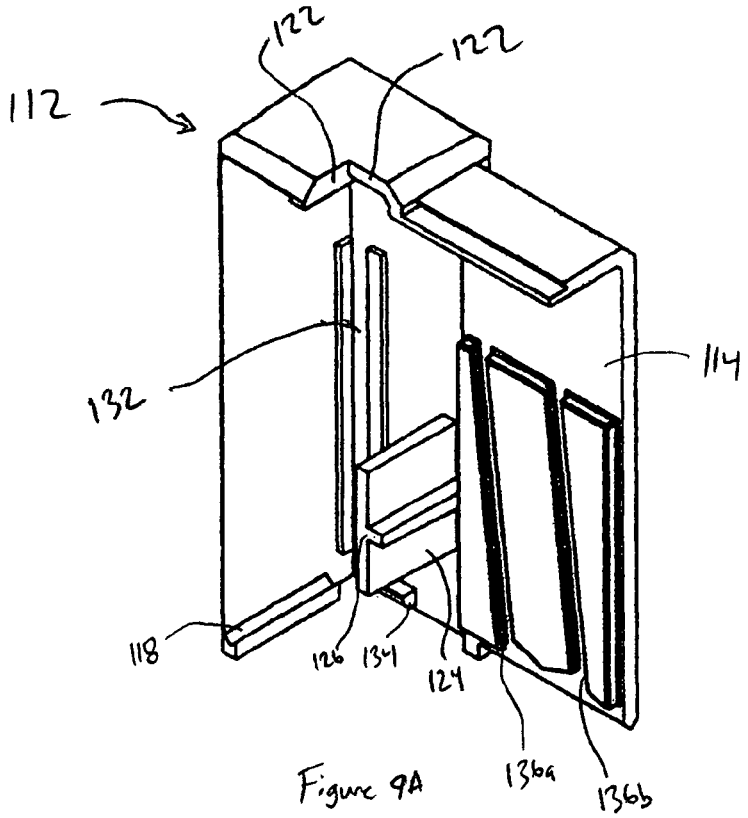
FIG. 9A is a perspective view of a corner component which forms part of another embodiment of a post wrap device.
Figure 9B:
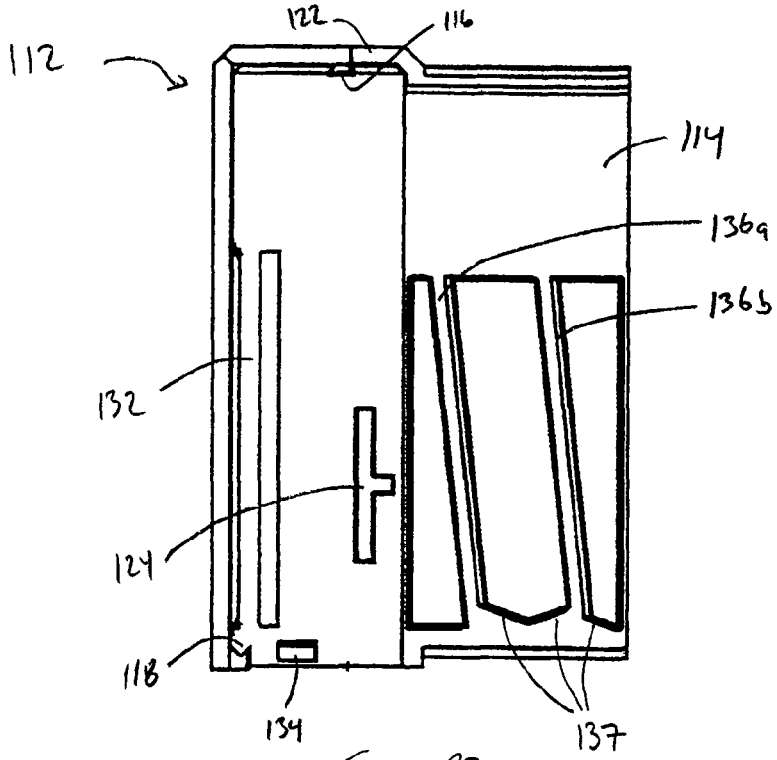
FIG. 9B is a side view of the corner component of FIG. 9B.

In a third embodiment, components of which are illustrated in FIGS. 9A-9B and 10A-10D, a post wrap apparatus comprises a plurality of corner components 112, described herein with respect to FIGS. 9A-9B, and a plurality of sliding spring clamps 140 described in greater detail below with respect to FIGS. 10A-10D. FIG. 9A is a perspective view of a corner component 112, and FIG. 9B is a side view of the corner component. To some extent, the design of the corner component 112 is similar to the design of the corner components 70 discussed above. The corner component 112 also includes a wing portion 114 which is configured to slidably interconnect with a wing portion of an adjacent corner component. In order to prevent the wing portion 114 of an interlocked corner component from moving towards or away from the post, the corner component 112 includes a raised member 116 extending across the upper interior surface of the corner component which is configured to restrain an upper portion of a wing portion 114. The corner component 114 also includes a groove 118 defined by a lipped member extending along the length of the open side 115 of the corner component near the base of the component, where the lip member is shaped to receive and retain the lower portion of a wing portion 114.

In addition, the corner component comprises two upper interior faces 122 orthogonal to one another, and configured to contact the surfaces of the post. The corner component 112 also comprises a spacer member 124 extending outward from the wing side of the corner component. The spacer member 124 has an interior face 126 configured to contact the surface of the post parallel to the wing portion 114 and to maintain the desired spacing. The spacer member 124 has a t-shaped cross section wherein the flat surface of the spacer member faces the open side 115 of the corner component 114, providing an area free from obstruction in which the sliding spring clamp, discussed in greater detail below, can be positioned.

In the illustrated embodiment, the corner component 112 comprises a groove 132 located along the interior surface of the corner component on the same side as the wing portion 114 and extending upwards from the base of the corner component to a point more than halfway up the interior surface of the corner component. The groove 132 is configured to receive a first slide, or rail feature, of a sliding spring clamp 140 (not shown). The corner component also includes comprises a stop 134 located near the base of the device and near the groove 132, which is configured to retain the sliding spring clamp. Preferably, the stop 134 has a rounded edge (not shown) facing downward, and a flat edge facing upward, so that a corresponding stop on the sliding spring clamp can be easily passed in one direction, but provide greater retention if the sliding spring clamp is attempted to be moved in the other direction.

The illustrated corner component 112 also includes two parallel grooves 136*a* and 136*b* located on the interior of the wing section and extending down a portion of the wing section, each of which is configured to receive a second slide of the sliding spring clamp. These grooves 136*a* and 136*b* are oriented at an angle to the groove 132.

Referring back to FIG. 9A, it can be seen in the illustrated embodiment that the members 135 extending from the wing portion and defining the grooves 136*a* and 136*b* have lower surfaces which are at an angle to the base of the corner component 112 and are angled toward the grooves, forming lead-in angles 137. The existence of these lead-in angles 137 on the underside of the members 135 greatly facilitates the assembly of the post wrap apparatus. This is because the slide of a sliding spring clamp, such as the slide 146 of the spring clamp 140 discussed below, will be guided naturally towards the appropriate groove when the spring clamp is pushed against the members 135 during the assembly process. This enables "blind" assembly of the final post wrap apparatus, a very helpful feature, as it could be very difficult to see the grooves 136*a* and 136*b* during assembly of the post wrap apparatus around a member.

Figure 10A:
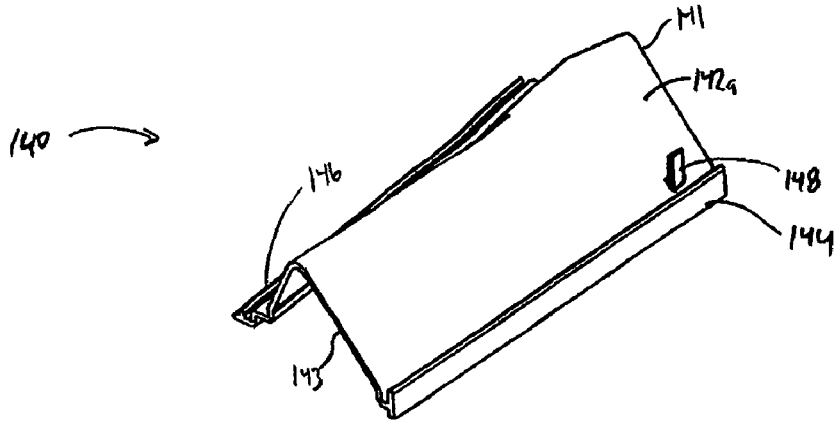
FIG. 10A is a perspective view of a sliding spring clamp which is usable in conjunction with the corner component of FIG. 9A in the post wrap device.
Figure 10B:
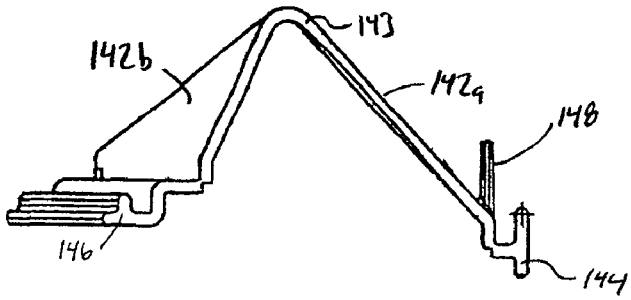
FIG. 10B is a view from underneath the sliding spring clamp of FIG. 10A.
Figure 10C:
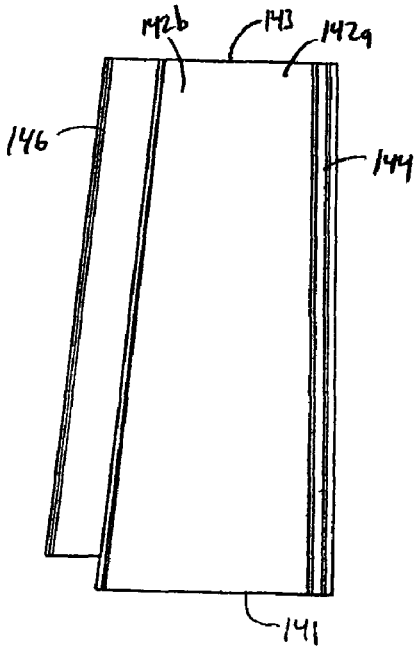
FIG. 10C is a side view of the sliding spring clamp of FIG. 10A.
Figure 10D:
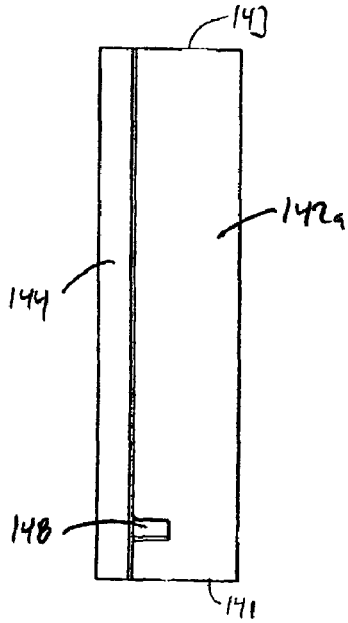
FIG. 10D is another side view of the sliding spring clamp of FIG. 10A.

As can be seen in FIG. 10A, the sliding spring clamp 140 comprises two essentially planar sections 142*a* and 142*b* oriented at an angle to one another, and oriented such that the angle between the two planar surfaces varies over the height of the spring clamp, the angle becoming smaller near the bottom 143 of the spring clamp. The sliding spring clamp 140 also comprises two slides, 144 and 146, located on either side of the spring clamp. Slide 144 is configured to be received vertically by groove 132 on the interior of corner component 112. As with the slide 58 forming a part of the spring member 56, the slides 144 and 146 comprise an elongated section having a substantially consistent cross-sectional shape. The slides 144 and 146 are attached to the rest of the spring clamp by a narrower portion, such that the glide can be slidably inserted into a groove or channel but restrained from moving in a direction orthogonal to the axis of the channel or groove. Slide 146 is oriented at the same angle to slide 144 as the grooves 136*a* and 136*b* are oriented with respect to the groove 132. Slide 146 is thus configured to be received by either groove 136*a* or 136*b*.

With respect to FIG. 10A, it can be seen that a stop 148 is located near the slide 144 and near the top edge 141 of the spring clamp 140, and is configured to contact stop 134 of the corner component 112 and thereby constrain the movement of the sliding spring clamp relative to the corner component, as discussed above. In the illustrated embodiment, the interaction between the stop 134 of the corner component 114 and the stop 148 of the sliding spring clamp 140 permits the spring clamp to be retained in place when the slide 146 is either not inserted into a groove 136*a* or 136*b*, or is only partially inserted into a groove. As each of the spring clamps can be connected to a corner component and held in place via these stops, the spring clips may be so attached in advance, greatly facilitating assembly of the post wrap apparatus.

Preferably, the sliding spring clamp 140 comprises a resilient deformable material, such as a polymeric material. The resilience of the sliding spring clamp permits the spring clamp 140 to be deformed such that the slides 144 and 146 may be pulled away from each other as necessary during assembly of the post cover apparatus, while the restoring force of the spring clamp pulls the slides back toward one another. Advantageously, the slide 146 may be inserted into either of groove 136*a* or 136*b*, depending on the particular dimensions of the post to be covered. In various embodiments, the corner components may comprise more or less than the two angled grooves 136*a*, 136*b*, in order to provide greater or less control over the interior dimensions of the post wrap apparatus 110.

Assembly of the post cover apparatus 110 may proceed as follows. The four corner components 112 are slidably interconnected with one another, defining a perimeter around the post 12. The sliding spring clamps 140 are then oriented such that the glides 144, 146 are positioned to enter their respective grooves, with the top end 141 of the spring clamp (the portion with the larger angle between the two planar sections) facing upwards. The spring clamps are then pushed upwards, pulling the two corner components together as the spring clamps are bent outward as they move upwards. The corner components are thus pulled flush against the post, and the restorative force of the spring claims ensures a snug fit against the post, while still permitting self-adjustment of the post cover apparatus due to variances in post dimensions.

It will be understood by a person having ordinary skill in the art that variations and combinations of the above-described embodiments are contemplated, and are within the scope of the invention. For example, FIGS. 11A-11C illustrate an alternate version of a corner component 150 to be utilized in conjunction with a sliding spring clamp such as the sliding spring clamp 140 of FIG. 10A.

Figure 11A:
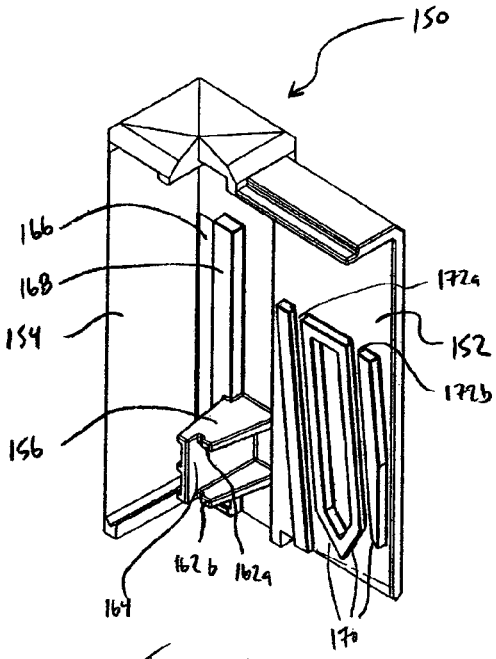
FIG. 11A is a perspective view of an alternate corner component which can be used with a sliding spring clamp.

First with respect to FIG. 11A, it can be seen that the corner component 150 comprises a spacer 156, which takes the form of a vertical planar member extending outward from the wing portion 152 of the corner component. The planar member of the spacer 156 is supported by trapezoidal members at the upper and lower sides of the planar member. The trapezoidal support members are notched on the side of the planar member away from the open side 154 of the corner component 150, resulting in two planar surfaces 162*a* and 162*b* configured to contact one side of the post. The spacer member 156 also includes a portion 164 of the planar member of the spacer 156 which is configured to contact the adjacent side of the post.

Figure 11B:
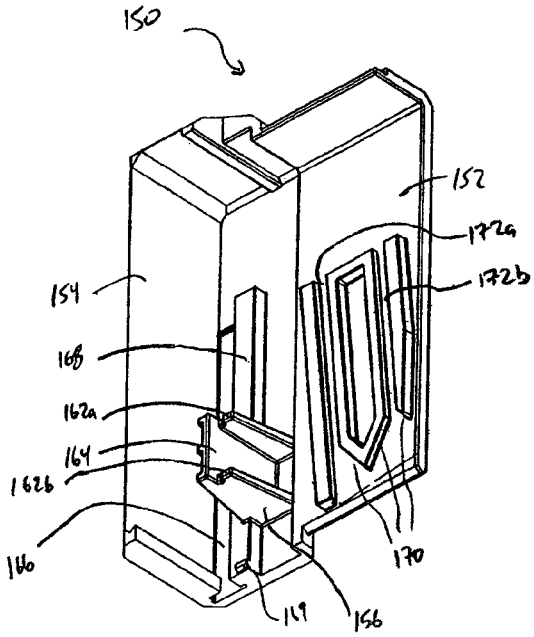
FIG. 11B is another perspective view, seen from underneath, of the corner component of FIG. 11A.

Next, with respect to FIG. 11B, it can be seen that the corner component comprises a shallow channel 166 cut into the wall interior surface of the corner component on the same side as the wing portion 152 and configured to receive a slide of a sliding spring clamp, such as the slide 144 of the sliding spring clamp 140 of FIG. 10A. The channel 166 is covered partially by an elongated member 168 extending slightly farther up the wall along the same portion of the wall as the shallow channel 166. The member 168 comprises a stop 169 extending outward from the wing portion side of the corner component. As discussed above, this stop 169 comprises a tapered or rounded underside, such that it is easier to push a stop on a spring clamp (such as the stop 148 of the spring clamp 140) upward past the stop 169 than it is to pull the spring clamp stop back over the stop 169 when removing the spring clamp.

Figure 11C:
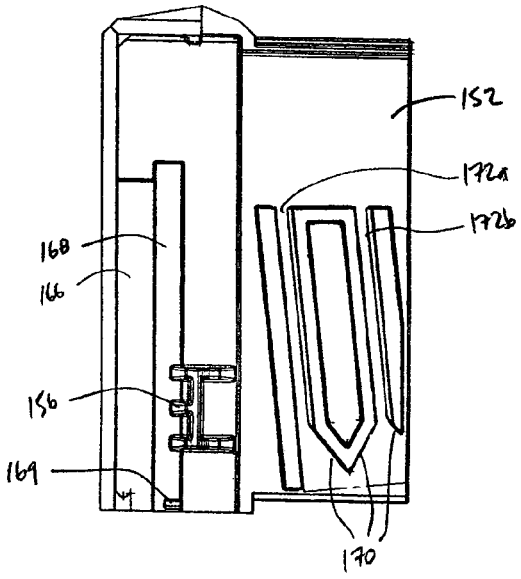
FIG. 11C is a side view of the corner component of FIG. 11A.

In addition, it can be seen in FIG. 11C that the lead-in angles 170 are more pronounced in this embodiment of a corner component than in the corner component 112 of FIG. 9A. This sharper angle with respect the base of the corner component 150 further facilitates the assembly of a post wrap device, as the glide of a sliding spring clamp (such as the guide 146 of the spring clamp 140) will be more easily directed towards the proper groove of the grooves 172*a* and 172*b*.

Figure 12A:
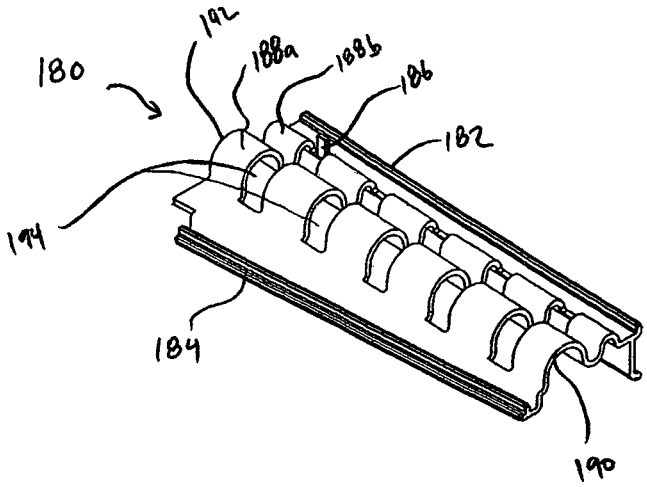
FIG. 12A is a perspective view of an alternate embodiment of a sliding spring clamp, which may be used with the corner component of FIG. 11A.
Figure 12B:
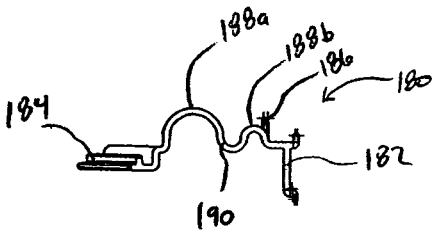
FIG. 12B is a view from underneath the sliding spring clamp of FIG. 12A.
Figure 12C:
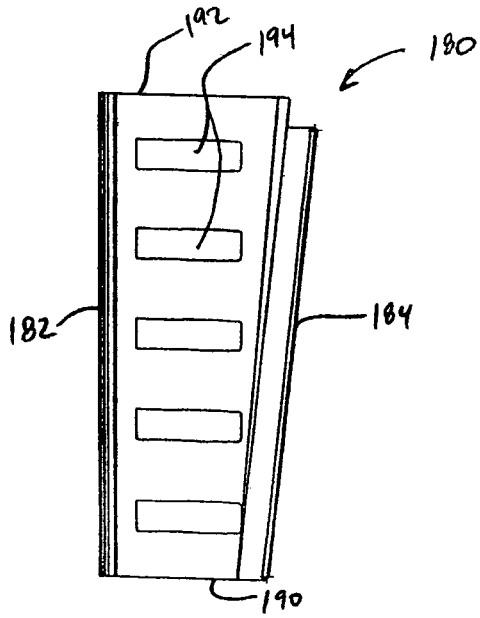
FIG. 12C is a side view of the sliding spring clamp of FIG. 12B.

FIGS. 12A-12C illustrate an alternate embodiment of a sliding spring clamp. With respect to FIG. 12A, it can be seen that like the sliding spring clamp 140 of FIG. 10A, the sliding spring clamp 180 comprises two glides 182 and 184, along with a stop 186 located near the glide 182. As can best be seen in FIG. 12B, however, the portion of the sliding spring clamp 180 between the glides 182 and 184 does not comprise two substantially planar sections, as in the spring clamp 140 of FIG. 10A. Rather, the middle portion of the sliding spring clamp comprises two arched substantially rounded portions 188*a*, 188*b* which extend from the base 190 of the spring clamp to the top edge 192.

By providing multiple bends in the spring clamp between the grooves, the profile of the spring clamp can be advantageously reduced. In particular, by decreasing the distance the spring clamp will extend inward towards the post from the interior surfaces of the assembled post wrap apparatus, the interior surfaces of the corner components may be positioned closer to the post. This permits either a reduction in size of the assembled device as a whole, or the fabrication of corner components having thicker walls without increasing the profile of the assembled post wrap apparatus.

In addition, it can be seen in FIG. 12C that the spring clamp 180 comprises apertures 194 in the middle portion of the spring device, extending through the rounded portions 188*a*,

188*b*. These apertures 194 can be cut into the spring clamp 180 in order to modify the behavior of the spring clamp through a reduction in the restoring force applied by the spring clamp.

As can be seen, a variety of modifications may be made to each of the above embodiments and are contemplated within the scope of the invention. In addition, as noted above, the invention is not limited to protective devices to be applied at the bases of posts, although the embodiments discussed above have primarily been described with respect to that use. Rather, as noted above, various embodiments may be used to circumscribe the extremity of an upright, perpendicular, or interconnecting frame component or member.

The embodiments discussed above may be manufactured in a variety of ways, and from a wide variety of components. In various embodiments, certain components discussed above may comprise polymeric materials. In particular, components such as a spring member 56 or a sliding spring clamp 140 or 180 may be advantageously formed from a polymeric material, as polymeric materials provide desirable flexibility and resilience. In other embodiments, visible components of the post wrap apparatuses may be advantageously formed from a wood composite material, particularly a wood/polymer composite. Such a wood composite provides the aesthetic appeal and functionality of wood components, permitting the components to be easily painted, for example, and these materials also provide additional advantages, such as durability, due to their composite nature. Nevertheless, these components may be formed from other materials, as well.

While the above detailed description has shown, described, and pointed out novel features of the invention as applied to various embodiments, it will be understood that various omissions, substitutions, and changes in the form and details of the device of process illustrated may be made by those skilled in the art without departing from the spirit of the invention. As will be recognized, the present invention may be embodied within a form that does not provide all of the features and benefits set forth herein, as some features may be used or practiced separately from others.

What is claimed is:

1. An apparatus for enclosing a portion of a member, comprising a plurality of corner components, a plurality of intermediate components, and a plurality of spring members extending from said plurality of corner components towards the member and configured to be secured to the member, each of said plurality of corner components contacting a different portion of the member and comprising at least two glides extending in directions substantially orthogonal to a central axis of the member, and each of said plurality of corner components adjustably connected to two adjacent intermediate components by inserting said glides into grooves on adjacent intermediate components such that the corner components are adjustable with respect to one another so as to be secured against the member, wherein said grooves comprise upper groove surfaces and lower groove surfaces extending in directions substantially orthogonal to the central axis of the member and defining a receiving space therebetween, wherein at least a portion of said glides are disposed within said receiving space.

2. The apparatus of claim 1, wherein at least one spring member is fixed to a corner component.

3. The apparatus of claim 2, additionally comprising a bracket secured to said at least one spring member, said bracket comprising a channel configured to receive a portion of said at least one spring member, wherein the channel extends in a direction substantially parallel to said central axis.

4. The apparatus of claim 3, wherein said at least one spring member comprises a glide, and wherein the channel in the bracket is configured to slidably receive said glide.

5. The apparatus of claim 1, wherein at least a portion of the apparatus comprises a polymeric material.

6. The apparatus of claim 1, wherein the at least a portion of the apparatus comprises a wood-polymer composite material.

7. The apparatus of claim 1, wherein said at least two glides are disposed on interior surfaces of the corner components.

8. A method for enclosing a portion of a member extending along a vertical axis, said method comprising:

adjustably connecting a plurality of corner components to a plurality of intermediate components about the surface of the member so as to define a perimeter, said perimeter coinciding with the dimensions of the member, wherein each of the corner components comprises a spring member extending towards the member, and wherein adjustably connecting a plurality of corner components to a plurality of intermediate components comprises inserting horizontally extending rail features located on the corner components into horizontally extending groove features located on two adjacent intermediate components such that a horizontally extending upper groove surface overlies a horizontally extending upper glide surface and a horizontally extending lower glide surface overlies a horizontally extending lower groove surface;

securing a plurality of brackets to said member, each of said plurality of brackets comprising a vertically extending channel; and securing each of said spring members to a bracket by inserting a portion of the spring member into the vertically extending channel in the bracket, such that said corner components are secured against a corner of the member via the restoring force of the spring members.

9. An apparatus for enclosing a portion of a member extending along a central axis, the apparatus comprising:

at least one bracket configured to be secured against an edge of the member extending substantially parallel to the central axis of the member, the bracket comprising a channel extending in a direction substantially parallel to the central axis and having a channel opening at one end;

a plurality of corner members, said plurality of corner members comprising a first glide extending in a first direction substantially orthogonal to the central axis and a second glide extending in a second direction substantially orthogonal to the central axis, the first and second glides comprising upper glide surfaces and lower glide surfaces extending in directions substantially parallel to the glides;

a plurality of intermediate members, said plurality of intermediate members comprising a groove feature configured to receive a portion of a first glide of a first corner member and a second glide of a second corner member, each of the groove features comprising an upper groove surface and a lower groove surface extending in directions substantially parallel to the groove and defining a receiving space therebetween, wherein the lower groove surface underlies the lower glide surfaces of said first glide and said second glide and said upper groove surface overlies the upper glide surfaces of said first glide and said second glide when said portions of first and second glides are received by said groove feature; and at least one spring member extending from at least one corner member towards the member to be enclosed, wherein said at least one spring member comprises a glide configured to be inserted into the channel of the bracket and translated at least partially along said channel.

10. The apparatus of claim 9, wherein the restoring force of the spring member secures a surface of said corner component against the member.

11. The apparatus of claim 9, wherein each of the plurality of intermediate members comprise at least two rail features defining the groove feature therebetween.

12. The apparatus of claim 11, wherein at least an upper rail feature of the at least two rail features comprises an undercut on its underside.

13. The apparatus of claim 12, wherein the glide members comprise an undercut on their upper surface substantially matching the undercut on the underside of the upper rail feature.

* * * * *